United States Patent [19]

Johnson

[11] 3,935,873

[45] Feb. 3, 1976

[54] COIN-DISPENSING DEVICE

[75] Inventor: Raymond Arthur Johnson, Hot Springs, Ark.

[73] Assignee: U.M.C. Industries, Inc., New York, N.Y.

[22] Filed: July 19, 1974

[21] Appl. No.: 490,133

[52] U.S. Cl. ..... 133/5 R; 221/270

[51] Int. Cl.[2] ..... G07D 1/00

[58] Field of Search ..... 133/4 R, 4 A, 5 R, 5 A, 133/5 B, 6; 221/263–266, 270, 272, 274, 276, 268; 194/10; 271/131–144

[56] References Cited

UNITED STATES PATENTS

| | | | |
|---|---|---|---|
| 893,450 | 7/1908 | Cross | 133/4 R |
| 929,550 | 7/1909 | Carney | 133/5 R |
| 1,036,645 | 8/1912 | Kleinbaum | 133/5 R |
| 1,560,385 | 11/1925 | Lang et al. | 133/5 R |
| 2,183,611 | 12/1939 | Goodman | 194/10 |
| 2,782,791 | 2/1957 | Sigo | 221/270 |
| 3,131,702 | 5/1964 | Buchholz et al. | 133/4 R |
| 3,814,115 | 6/1974 | Van Acker | 133/4 |

*Primary Examiner*—Robert B. Reeves
*Assistant Examiner*—H. Grant Skaggs
*Attorney, Agent, or Firm*—Rogers, Ezell & Eilers

[57] ABSTRACT

A coin-moving member adjacent a coin-holding tube has a surface which can engage one part of the periphery of the end-most coin. Each endmost coin defines a plane perpendicular to the axis of the coinholding tube; and a connection between a coin-moving member and a source of motive power is intermediate that plane and the opposite end of the coin-holding tube. As the source of motive power moves the coin-moving member to dispense a coin, an axially-directed component of force will develop between the coin-engaging surface of the coin-moving member and the periphery of that coin; and that axially-directed component of force will be directed toward the opposite end of the coin-holding tube, and it will hold that coin-engaging surface in tight engagement with the periphery of that coin. During the returning movement of the coin-moving member, a spring causes a lever to apply a light pressure to the coin-moving member to urge the coin-engaging surface into engagement with the lower face of the next-to-be-dispensed coin; but that light pressure does not create much friction between that coin-engaging surface and that lower face.

10 Claims, 11 Drawing Figures

COIN-DISPENSING DEVICE

BACKGROUND OF THE INVENTION

Where a source of power moves a coin-moving member to dispense coins from a coin-holding tube, it is desirable that an intimate engagement be provided and maintained between that coin-moving member and each moved coin during the coin-dispensing stroke of that coin-moving member, but that the coin-moving member apply only a very light pressure to the next-to-be-dispensed coin during the return stroke of that coin-moving member. By providing only a light pressure between that coin-moving member and the next-to-be-dispensed coin, during the return stroke of that coin-moving member, it is possible to reduce the force which is required to move that coin-moving member through its return stroke. By reducing that returning force, it is possible to reduce the amount of power which is required to actuate the source of motive power; and it also is possible to reduce the tendency of that coin-moving member to cock or tilt the endmost coin in the outlet end of the coin-holding tube.

Summary of the Invention: The present invention disposes a coin-moving member adjacent the outlet end of a coinholding tube, and it provides a source of motive power to move that coin-moving member transversely of the outlet end of the coin-holding tube. Each endmost coin which is disposed in that outlet end defines a plane which is perpendicular to the axis of the coin-holding tube; and a connection between the coin-moving member and the source of motive power is intermediate that plane and the opposite end of the coin-holding tube. As the source of motive power moves the coin-moving member to dispense a coin, an axially-directed component of force will develop between the coin-engaging surface of the coin-moving member and the periphery of that coin; and that axially-directed component of force will be directed toward the opposite end of the coin-holding tube, and it will hold that coin-engaging surface in tight engagement with the periphery of that coin. However, during the returning movement of the coin-moving member, an axially-directed component of force will be developed which will tend to move the coin-engaging surface away from the exposed surface of the next-to-be-dispensed coin. It is, therefore, an object of the present invention to provide a coin-moving member adjacent the outlet end of a coin-holding tube, a source of motive power to move the coin-moving member transversely of the outlet end of the coin-holding tube, and to provide a connection between the coin-moving member and the source of motive power which is intermediate the opposite end of the coin-holding tube and a plane which is defined by each endmost coin in the outlet end of the coin-holding tube, so an axially-directed component of force will develop between the coin-engaging surface of the coin-moving member and the periphery of that endmost coin which will hold that coin-engaging surface in tight engagement with the periphery of that coin while the coin-moving member moves that endmost coin to coin-dispensing position.

A lever applies a light pressure to the coin-moving member to urge the coin-engaging surface of that coin-moving member into register with the periphery of the next-to-be-dispensed coin after that coin-engaging surface has slid across the exposed face of that next-to-be-dispensed coin. However, that light pressure does not create much friction between that coin-engaging surface and that exposed face. Consequently, the amount of power required to dispense coins is substantially reduced without any risk of the coin-engaging surface slipping out of engagement with the endmost coin in the outlet end of the coin-holding tube. It is, therefore, an object of the present invention to provide a lever which applies a light pressure to the coin-moving member to urge the coin-engaging surface of that coin-moving member into register with the periphery of the next-to-be-dispensed coin after that coin-engaging surface has slid across the exposed face of that next-to-be-dispensed coin.

Other and further objects and advantages of the present invention should become apparent from an examination of the drawing and accompanying description.

In the drawing and accompanying description a preferred embodiment of the present invention is shown and described but it is to be understood that the drawing and accompanying description are for the purpose of illustration only and do not limit the invention and that the invention will be defined by the appended claims.

DESCRIPTION OF THE PREFERRED EMBODIMENT

Figures 1, 2, 3, 4:
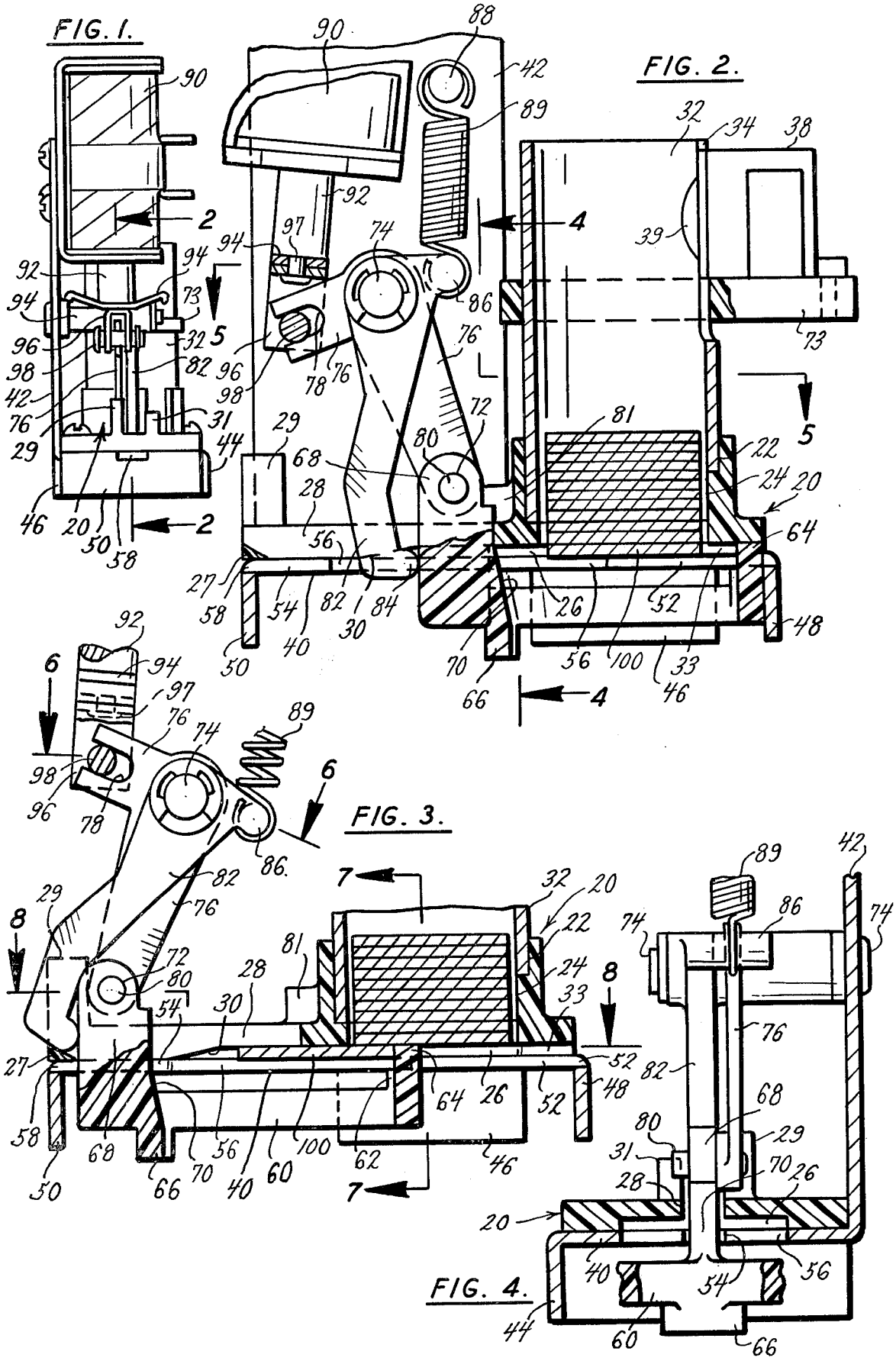
FIG. 1 is an end elevational view of one preferred embodiment of coin-dispensing device that is made in accordance with the principles and teachings of the present invention.
FIG. 2 is a sectional view, on a larger scale, through part of the coin-dispensing device of FIG. 1, and it is taken along the broken plane indicated by the broken line 2—2 in FIG. 1.
FIG. 3 is a sectional view, on the scale of FIG. 2, through the coin-dispensing device of FIG. 1, and it is taken along the broken plane indicated by the broken line 2—2 in FIG. 1, but it shows the coin-moving member in coin-dispensing position.
FIG. 4 is a sectional view, on the scale of FIG. 2, through the coin-dispensing device of FIG. 1, and it is taken along the broken plane indicated by the broken line 4—4 in FIG. 2.
Figure 8:
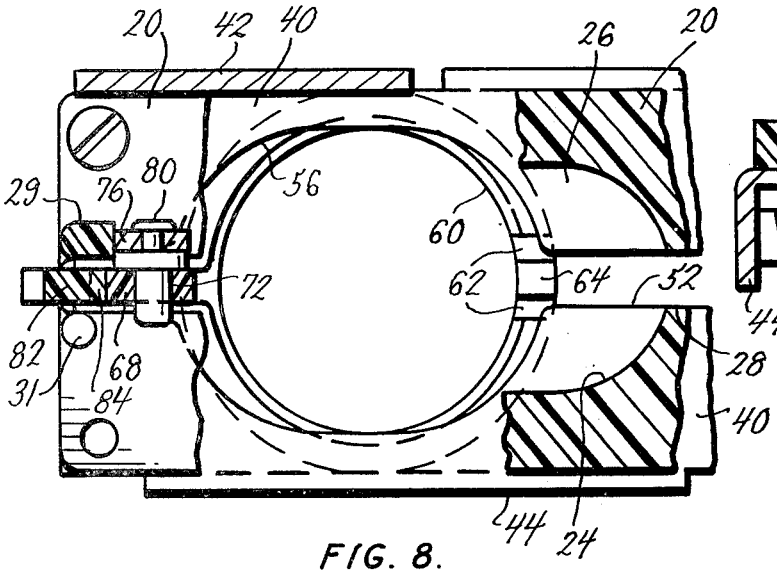
FIG. 8 is a sectional view, on the scale of FIG. 2, through the coin-dispensing device of FIG. 1, and it is taken along the broken plane indicated by the broken line 8—8 in FIG. 3.

Referring to the drawing in detail, the numeral 20 generally denotes a mounting which has the form of a horizontally-directed base with a vertically-upstanding annulus that defines a cylindrical passage 24. An annular recess 22 is provided in the upper end of that annulus to accommodate the lower end of a coin-holding tube 32. A shallow, horizontally-directed, rounded end recess 26 is formed in the lower surface of the mounting 20, as shown by FIGS. 2, 4 and 8; and that recess communicates with the cylindrical passage 24, as indicated by FIGS. 2 and 3. A slot 28 in the base extends upwardly from the recess 26, as shown particularly by FIGS. 2–4; and the upper portion of that slot extends to the left-hand end of the mounting 20, as that mounting is viewed in FIGS. 2 and 3. The lower portion of the left-hand end of the slot 28 is closed by a portion 27 of triangular cross section, as shown by FIG. 2. A shallow slot 33 is formed in the lower surface of the mounting 20, as shown particularly by FIGS. 2 and 3; and that slot extends between the recess 26 and the right-hand end of that mounting. The numeral 30 denotes an inclined surface which defines the left-hand end of the recess 26, as that recess is viewed in FIGS. 2 and 3. The numeral 29 denotes a projection which extends upwardly from the upper surface of the mounting 20 and which is located adjacent the left-hand end of that mounting, as that mounting is viewed in FIGS. 2, 3, 5 and 8; and that projection is located at one side of the slot 28, as shown particularly by FIG. 5. The numeral 31 denotes a cylindrical projection which extends upwardly from the upper surface of the mounting 20 and which is displaced from the projection 29 by the slot 28; and that projection is shorter than the projection 29.

The numeral 34 denotes a vertically-directed slot in the upper portion of the wall of the coin-holding tube 32, as shown particularly by FIG. 2. The numeral 73 denotes a resilient collar which is telescoped downwardly over the upper end of that coin-holding tube; and that resilient collar holds a level-sensing device 38 in register with that slot. The numeral 39 denotes the actuator of that level-sensing device; and that actuator is biased for movement inwardly through the slot 34 into the interior of that coin-holding tube. However, that actuator can be moved outwardly of that coin-holding tube by coins which are stacked in vertical array within that coin-holding tube. The normal, unstressed inner diameter of the resilient collar 73 is less than the outer diameter of the coin-holding tube 32; but a U-shaped expansible portion 36 of that resilient collar permits that inner diameter to be increased sufficiently to enable that resilient collar to be telescoped downwardly over the upper end of that coin-holding tube. That U-shaped expansible portion will enable that resilient collar to be set, and thereafter to automatically maintain itself, in any desired position along the length of that coin-holding tube. Adjustment of the position occupied by the resilient collar 73 permits adjustment of the number of coins which must be present in the coin-holding tube 32 to keep the actuator 39 out of the interior of that coin-holding tube.

Figure 5:
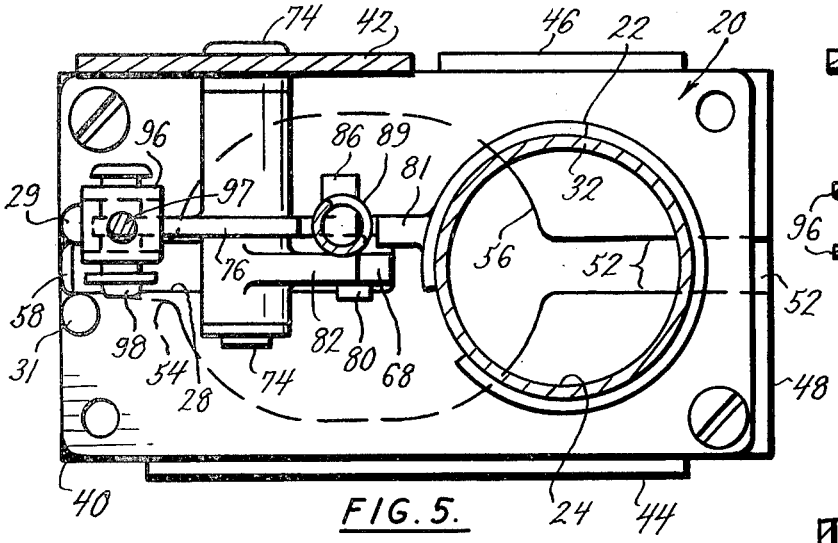
FIG. 5 is a sectional view, on the scale of FIG. 2, through the coin-dispensing device of FIG. 1, and it is taken along the broken plane indicated by the broken line 5—5 in FIG. 2.
Figure 6:
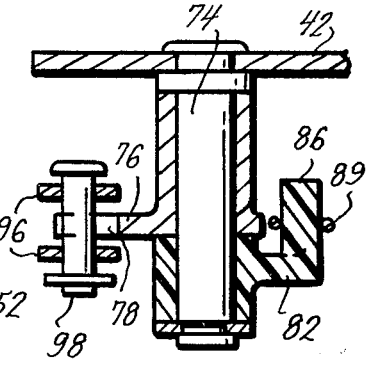
FIG. 6 is a sectional view, on the scale of FIG. 2, through the coin-dispensing device of FIG. 1, and it is taken along the plane indicated by the line 6—6 in FIG. 3.

The numeral 40 denotes a supporting surface which is shown as a metal plate, and which has an upwardly-bent wall 42 adjacent the left-hand end of one side thereof, as that supporting surface is viewed in FIG. 5.

Figure 9:
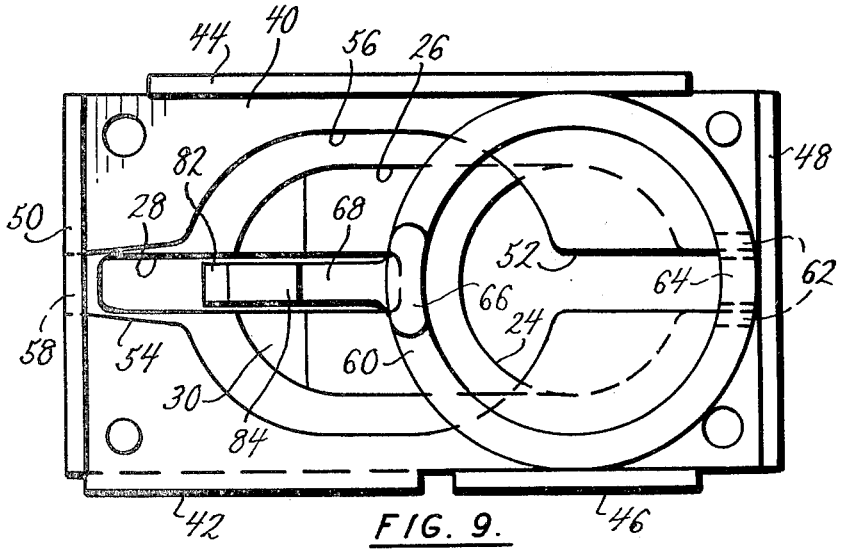
FIG. 9 is a bottom view, on the scale of FIG. 2, through the coin-dispensing device of FIG. 1.
Figure 11:
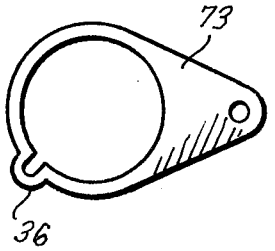
FIG. 11 is a plan view of a resilient collar for the coin-holding tube of the coin-dispensing device of FIG. 1.

The numeral 46 denotes a downwardly-bent flange on that same side of that supporting surface; and the numeral 44 denotes an elongated downwardly-bent flange on the opposite side of that supporting surface. The numeral 48 denotes a downwardly-bent flange at the right-hand end of the supporting surface 40, as that supporting surface is viewed in FIGS. 2, 3, 5 and 9; and the numeral 50 denotes a downwardly-bent flange at the opposite end of that supporting surface. A slot 52, of constant width, extends inwardly from the downwardly-bent flange 48, as shown particularly by FIGS. 2, 3, 8 and 9; and a slot 54, of frustro-triangular form, extends inwardly from the flange 50, as shown particularly by FIG. 9. The slots 52 and 54 are aligned; and they communicate with an opening 56 in the supporting surface 40 that has rounded ends and that defines an area which is larger than the area which is defined by the bottom of the cylindrical passage 24. The opening 56 is displaced from the cylindrical passage 24, as shown particularly by FIG. 9; and the portions of the supporting surface 40 which are adjacent the junction of slot 52 and the opening 56 underlie that cylindrical passage. Those portions of that supporting surface normally support the lowermost coin 100 in the stack of coins within the coin-holding tube 32. A notch 58 is provided in the upper edge of the flange 50, as shown particularly by FIG. 1; and that notch helps define the outer end of the slot 54.

The numeral 60 denotes a ring-like coin-moving member which has an inner diameter that is approximately equal to the transverse dimension of the opening 56 in the supporting surface 40, as shown particularly by FIG. 8. The radius of either end of the opening 56 is approximately equal to the inner diameter of the coin-moving member 60. Actually, the inner surface of the ring-like coin-moving member 60 is generally frusto-conical, as shown by dotted lines in FIG. 7; and the upper end of the space which is defined by that member is larger than the lower end of that space. However, as indicated by FIG. 7, the smallest-diameter end of the space which is defined by the ring-like coin-moving member 60 is considerably larger than the diameter of the cylindrical passage 24 in the mounting 20.

Figure 7:
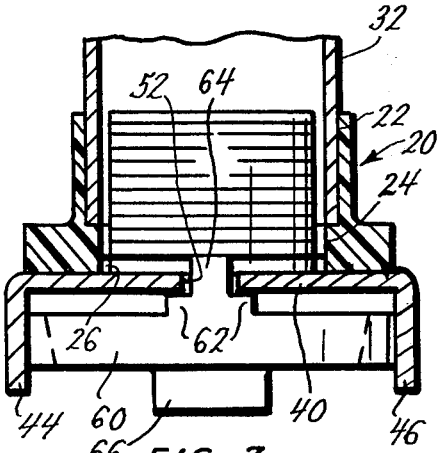
FIG. 7 is a sectional view, on the scale of FIG. 2, through the coin-dispensing device of FIG. 1, and it is taken along the plane indicated by the line 7—7 in FIG. 3.

A projection 62 extends upwardly from one side of the ring-like coin-moving member 60, as shown particularly by FIGS. 7 and 8; and a narrower coin-engaging surface 64 extends upwardly from the upper surface of that projection. That coin-engaging surface and that projection are arcuate in plan, as indicated by FIG. 8. The coin-engaging surface has a height which is slightly greater than the sum of the depth of the slot 33 and the thickness of the supporting surface 40. This means that when the upper face of the coin-engaging surface 64 is in engagement with the top of the slot 33, the upper surfaces of the projection 62 will be below, and out of engagement with, the under face of the supporting surface 40.

The numeral 66 denotes a downwardly-extending projection on the ring-like coin-moving member; and the numeral 68 denotes an ear which extends upwardly from that ring-like coin-moving member. The downwardly-extending projection 66 and the ear 68 are disposed at one side of the ring-like coin-moving member, and the upwardly-extending projection 62 and the coin-engaging surface 64 are disposed at the opposite side of that ring-like coin-moving member. The numeral 70 denotes an inclined inner face on the ear 68; and the numeral 72 denotes an opening in that ear. The ring-like coin-moving member 60, the projections 62 and 66 thereon, the coin-engaging surface 64, and the ear 68 preferably are molded as a unit.

The numeral 74 denotes an elongated pivot which is secured to the wall 42; and that pivot is disposed to the left of the coin-holding tube 32, as that coin-holding tube is viewed in FIG. 2. A bell crank lever 76 has the hub thereof telescoped over the pivot 74, and it has a slot 78 in the short arm thereof. The long arm of that bell crank lever extends downwardly toward the ear 68 of the coin-moving member 60; and a shouldered pin 80 pivotally secures that long arm to that ear. A stop 81 is formed on the mounting 20 in register with the lower end of the bell crank lever 76; and that stop also is preferably formed as a unit with that mounting.

The numeral 82 denotes an elongated lever with the hub thereof telescoped over the pivot 74; and that lever has a toe-like projection 84 in register with the ear 68 on the coin-moving member 60. An ear 86 at the upper end of the lever 82 is below, but generally in register with, a screw 88 which extends forwardly from the wall 42. A helical extension spring 89 has the upper end thereof hooked around the screw 88, and has the lower end thereof hooked around the ear 86 on the lever 82. That spring biases the lever 82 for rotation in the counter-clockwise direction in FIG. 2; but, as shown by FIG. 3, that spring can yield to permit that lever to be rotated in the clockwise direction from the position of FIG. 2 to the position of FIG. 3.

The numeral 90 denotes a solenoid which is mounted on the wall 42 with its axis vertical; and the armature 92 of that solenoid has a leaf-type spring 94 and an inverted U-shaped bracket 96 secured to the lower end thereof by a fastener 97. A pin 98 is held by the inverted U-shaped bracket 96; and that pin passes through the slot 78 in the short arm of the bell crank lever 76 to enable the armature 92 of the solenoid 90 to rotate that bell crank lever.

Standby condition of the Preferred Embodiment: Whenever the solenoid 90 is de-energized, there will be no upward force acting upon the armature 92; and, instead, the helical extension spring 89 and gravity will be urging that armature downwardly into the position of FIG. 2. Specifically, that helical extension spring will be applying an upwardly-directed force to the ear 86 of the lever 82, the toe 84 of that lever will be applying a force which will urge the coin-moving member 60 to the right as viewed in FIG. 2; and that coin-moving member will be acting through the pin 80 to urge the bell crank lever 76 into engagement with the stop 81, as shown by FIG. 2 — with consequent holding of the pin 98 and, via the U-shaped bracket 96 and the fastener 97, of the armature 92 in the position of FIG. 2. Consequently, whenever the solenoid 90 is de-energized, the coin-moving member 60 will have the ring-like portion thereof below, and concentric with the axis of, the coin-holding tube 32. At such time, the force which the toe 84 of the lever 82 applies to the ear 68 of that coin-moving member will develop a rotative moment which will cause the upper edge of the projection 64 to bear against the top of the slot 33 in the under surface of the mounting 20, as shown particularly by FIG. 2.

The slot 33 has a depth which is just slightly less than the thickness of a freshly-minted coin of the denomination of coin to be dispensed by the coin-dispensing device. Specifically, if pennies are to be dispensed from the coin-holding tube 32, the slot 33 will have a depth just slightly less than the thickness of a freshly-minted penny. Similarly, if the coin-holding tube 32 is to hold nickels, dimes, quarters or half-dollars, the depth of the slot 33 will be just slightly less than the thickness of a nickel, dime, quarter or half-dollar, respectively. This means that whenever the coin-holding tube 32 has freshly-minted coins therein, the top of the slot 33 will be just a short distance below a plane defined by the upper surface of the lowermost coin 100; and hence the top of the coin-engaging surface 64 also will be just a short distance below that plane. The pin 80 is, however, intermediate that plane and the opposite end of the coin-holding tube 32. As a result, whenever the coin-dispensing device is in its "standby" condition, an imaginary line which passes through the axis of the pin 80 and extends to the point of engagement between the periphery of the coin 100 and the adjacent face of the coin-actuating surface 64 will be coincident with the vector 101 in FIG. 10. That imaginary line is displaced from the axis of the coin-holding tube 32 by a large acute angle.

Operation of the Preferred Embodiment: Whenever the solenoid 90 is energized, the armature 92 will be pulled upwardly; and it will act through fastener 97, bracket 96 and pin 98 to rotate the bell crank lever 76 in the clockwise-direction in FIG. 2 — thereby moving that bell crank lever, the lever 82, and the coin-moving member 60 from the positions of FIG. 2 to the positions of FIG. 3. During the movement of that coin-moving member from the position of FIG. 2 to the position of FIG. 3, the ear 68 of that coin-moving member will bear against the toe 84 on the lever 82 and will force that lever to rotate in the clockwise-direction; but the helical extension spring 89 will cause that toe to apply a force to that ear which is below the level of the axis of the pin 80. This means that a rotative moment will urge the upper face of the coin-engaging surface 64 upwardly against the top of the slot 33, until that upper face has moved inwardly beyond the radially-inner end of that slot; and then that rotative moment will urge the upper face of that coin-engaging surface upwardly into engagement with the under surface of the next-to-be-dispensed coin.

Figure 10:
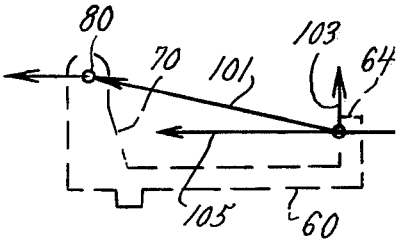
FIG. 10 is a vector diagram of forces which are developed during the moving of the coin-moving member to coin-dispensing position.

As the bell crank lever 76 moves the coin-moving member 60 toward the position of FIG. 3, the ring-like portion of that coin-moving member will cause the coin-engaging surface 64 to move the coin 100 to the left in FIG. 2. Because the axis of the pin 80 is intermediate the plane of that coin and the upper end of the coin-holding tube 32, the force which the bell crank lever 76 applies to the coin-moving member 60 will develop the vector 101 within that coin-moving member. That vector has a vertically-directed component 103 and a horizontally-directed component 105, as shown by FIG. 10. The horizontally-directed component 105 will cause the coin-moving member 60 to force the coin 100 to move to the left; and the vertically-directed component 103 will hold the coin-engaging surface 64 up in intimate engagement with the periphery of that coin. As a result, even though there is only a small area of engagement between the coin-actuating surface 64 and the periphery of the coin 100, that coin-engaging surface will not slip downwardly and out of engagement with that coin — even if that coin is slightly bent or is slightly worn so the periphery of that coin is not parallel to the axis of the coin-holding tube 32.

In the event the coin 100 was an extremely thin, heavily-worn coin, the plane which was defined by the upper surface of that coin might be below the level of the top of the slot 33, and hence might be below the upper face of the coin-engaging surface 64. Consequently, the top of the inner face of that coin-engaging surface might be in register with the lowermost part of the periphery of the next-to-be-dispensed coin. In such event, the horizontally-directed component 105 would tend to cause the coin-moving member 60 to move the next-to-be-dispensed coin, as well as the coin 100, to the left. However, the lower edge of the cylindrical passage 24 within the mounting 20 would prevent movement of that next-to-be-dispensed coin to the left; and hence the top of the inner face of the coin-engaging surface 64 would have to move downwardly a few thousandths of an inch to be below, and out of register with, the periphery of that next-to-be-dispensed coin. Such downward movement can occur readily; because the edges of the coins within the coin-holding tube 32 will be slightly rounded, and those rounded edges will simulate inclined planes which can help guide the top of the coin-engaging surface 64 downwardly a few thousandths of an inch. Also, the rotative moment which the toe 84 of the lever 82, the pin 80, and the helical extension spring 89 develop for the coin-moving member 60 is sufficiently small to enable the top of the coin-engaging surface 64 to move downwardly below the plane of the lower surface of the next-to-be-dispensed coin. Specifically, the upwardly-directed force which the helical extension spring 89 develops for the coin-engaging surface 64 is equal to the force which the toe 84 applies to the ear 68 multiplied by the ratio of the distance between the axis of pin 80 and that toe and the distance between that axis and that coin-engaging surface. Because the distance between the axis of pin 80 and the toe 84 is small compared to the distance between that axis and the coin-engaging surface 64, the upwardly-directed force which the helical extension spring 89 develops at that coin-engaging surface is large enough to hold the top of that coin-engaging surface against the top of the slot 33 but is small enough to permit the top of that coin-engaging surface to move downwardly below the plane defined by the lower surface of any next-to-be-dispensed coin in the coin-holding tube 32. All of this means that even if the coin 100 is a well-worn coin, and that even though the helical extension spring 89 constantly applies upwardly-directed forces to the coin-engaging surface 64, the top of that coin-engaging surface can automatically move downwardly until it is able to pass below the lower face of the next-to-be-dispensed coin.

As the coin-engaging surface 64 forces the coin 100 to move to the left in FIGS. 2 and 3, the walls of the recess 26 in the under surface of the mounting 20 will guide that coin. In practice, the portions of that recess which are straight will coact with the coin-engaging surface 64 on the coin-moving member 60 to provide three points of guidance for that coin. During the movement of the coin 100 toward the left-hand end of the recess 26, the leading edge of that coin will approach the inclined surface 30 at the under surface of that recess. Prior to the time the leading edge of that coin engages that inclined surface, the trailing edge of that coin will move to the left beyond the portions of the supporting surface which define the slot 52. At that time, gravity will tend to start moving that coin downwardly and out of the recess 26; but the coin-engaging surface 64 will still be applying to that coin the horizontally-directed component of force represented by the vector 105. The resulting frictional engagement between that coin-engaging surface and the periphery of that coin will resist downward movement of the trailing edge of that coin. The speed at which the solenoid 90 will move the coin-moving member 60, and hence the coin 100, will be quite high; and hence the leading edge of that coin will not have moved downwardly very far, in response to gravity, before that leading edge engages the downwardly inclined surface 30. The engagement between the leading edge of the coin and that downwardly-inclined surface will, of course, force that leading edge downwardly, and hence toward the inclined surface 70 of the ear 68. The momentum within the coin 100 will tend to cause that coin to continue to move to the left, but the leading edge of that coin will strike the right-hand edge of the ear 68, and thus will be prevented from continuing to move to the left. As a result, that coin will drop downwardly; and the tapered inner surface of the ring-like portion of the coin-moving member 60 will coact with the large inner diameter of that ring-like portion to permit that coin to fall downwardly without any appreciable resistance to its downward fall. That coin then will pass to a coin-retrieving receptacle which is accessible to the person to whom that coin is to be dispensed.

As the trailing edge of the coin 100 was moved to the left beyond the underlying portions of the supporting surface 40, the weight of the remaining coins within the coin-holding tube 32 moved that coin and the coin-engaging surface 64 downwardly a distance equal to the thickness of that coin. However, as the next-to-be dispensed coin engaged, and became supported by, the supporting surface 40, the remaining coins within the coin-holding tube 32 were kept from applying further downwardly-directed forces to that coin. At such time, the under surface of the next-to-be dispensed coin engaged the top of the coinengaging surface 64; and the force applied by the helical extension spring 89 urged that top into engagement with that under surface. Because of the ratio of the moment arms of that coin-engaging surface and of the toe 84, relative to the axis of the pin 80, the upwardly-directed force which the top of that coin-actuating surface applies to that next-to-be-dispensed coin is small enough to avoid tilting, raising or cocking of that coin — even if that coin is the last coin within the coin-holding tube 32. In this way, the present invention avoids needless service calls for the coin-dispensing device.

The coin-moving member 60 will remain in its left-hand position as long as the solenoid 90 is energized; but the helical extension spring 89 will act through the lever 82 to start moving that coin-moving member back to its "standby" position as soon as that solenoid is de-energized. In addition, that helical extension spring will continue to urge the coin-engaging surface 64 upwardly; but the top of that coin-engaging surface 64 will be underlying the next-to-be-dispensed coin, and the weight of that next-to-be-dispensed coin will prevent counter clockwise rotation of the coin-moving member 60. Consequently, the force which the toe 84 applies to the ear 68 will merely cause the coin-moving member 60 to move back to its "standby" position.

When the coin-engaging surface 64 has been moved beyond the right-hand edge of the next-to-be-dispensed coin, the force which is applied by the helical extension spring 89 will cause the top of that coin-engaging surface to move up into engagement with the top of the slot 33. At that time, the upper edge of the inner face of that coin-engaging surface will be in register with the periphery of that next-to-be-dispensed coin. This means that the coin-dispensing device will be in condition to dispense that next-to-be-dispensed coin when the solenoid 90 is again energized.

As the coin-moving member 60 approaches its "standby" position, the lower end of the bell crank lever 76 will move into engagement with the stop 81 on the mounting 20. The engagement between the lower end of that bell crank lever and that stop will properly position the ring-like portion of that coin-moving member, relative to the bottom of the coin-holding tube 32, without requiring any stopping or halting forces to be applied directly to that coin-moving member.

During the movement of the coin-moving member 60 between its "standby" position and the moved position of FIG. 3, the coin-engaging surface 64 will remain within the slot 52 in the supporting surface 40. As a result, that coin-engaging surface will always be in alignment with the slot 33 in the under surface of the mounting 20; and hence that coin-engaging surface can move up into engagement with the top of that slot as the coin-moving member 60 moves back into its standby position.

It will be noted that the point of engagement between the toe 84 of the lever 82 and the ear 68 of the coin-moving member 60 is lower in FIG. 2 than it is in FIG. 3. This is desirable, because it enables the restorative forces which the helical extension spring 89 applies to that coin-moving member to have a smaller moment arm in FIG. 3 than it has in FIG. 2. As a result, even though the value of the forces which that helical extension spring applies to the ear 68 is greater in FIG. 3 than it is in FIG. 2, there is not a corresponding one-to-one increase in the upwardly-directed force which the top of the coin-engaging surface 64 applies to the under surface of the next-to-be-dispensed coin during the return stroke of the coin-moving member 60. This means that the spring-induced resistance to the return stroke of the coin-moving member 60 is relatively small; and hence the helical extension spring 89 need not develop a strong returning force. Because that helical extension spring need not develop a strong returning force, the solenoid 90 does not have to overcome such a force; and hence that solenoid can be made so it does not require much power. As a result, by use of the present invention, it is possible to substantially reduce the power that is required to operate the solenoid 90. In the preferred embodiment of the present invention, the helical extension spring 89 causes the top of the coin-engaging surface 64 to apply a force of only five grams in the under face of the next-to-be-dispensed coin during the returning stroke of the coin-moving member 60. Such a light force makes it possible to reduce the power required by the solenoid 90 by almost forty percent (40%).

The ear 68 on the ring-like coin-moving member 60 limits the extent to which dispensed coins can move to the left in FIG. 3. Also, that coin-moving member moves dispensed coins into an area which underlies the solenoid 90. The overall result is that the horizontal dimension of the coin-dispensing unit 38 is desirably small.

In the standby condition of the coin-dispensing device, the ear 68 on the coin-moving member 60 lies in the path of the coin 100. As a result, that ear will keep that coin from being released by that coin-dispensing device, even if extremely heavy horizontally-directed blows are applied to that coin-dispensing device with the intent of causing that coin to shift to the left from its position in FIG. 2.

Whenever the level of the coins in the coin-holding tube 32 is low enough to enable the actuator 39 of the level-sensing device 38 to move inwardly through the slot 34 in that coin-holding tube, that level-sensing device will develop a signal which can be applied to a suitable utilization device. However, whenever the coins within that coin-holding tube constitute a stack which is high enough to hold that actuator outwardly of the inner surface of that coin-holding tube, that level-sensing device will either provide no signal or will provide a distinctly-different signal. The level-sensing device 38 could be a switch with metallic contacts, could be a photo-coupler, or could be one of the standard level-sensing devices used in the coin-handling field.

The lever 82 is very useful and desirable; but, if desired, that lever could be eliminated. In such event, the lower end of the helical extension spring 89 would be connected directly to the bell crank lever 76; and a light weight spring would be used to urge the coin-engaging surface 64 in the coin-moving member 60 upwardly. That light weight spring would apply an upwardly-directed force to the coin-moving member 60 which was smaller than the horizontally-directed force which the bell crank lever 76 applied to that coin-moving member. As a result, the upwardly-directed and the horizontally-directed forces which the helical extension spring 89 and the light weight spring apply to the coin-moving member 60 will be comparable to the upwardly-directed and the horizontally-directed forces which the helical extension spring 89 of FIGS. 2–4 apply to that coin-moving member.

Whereas the drawing and accompanying description have shown and described a preferred embodiment of the present invention, it should be apparent to those skilled in the art that various changes may be made in the form of the invention without affecting the scope thereof.

What I claim is:

1. A coin-dispensing device which comprises a coin-holding tube that has a first end and a second end, a holding surface adjacent said first end of said coin-holding tube which can help hold a coin adjacent said first end of said coin-holding tube, a coin-moving member movably mounted adjacent said first end of said coin-holding tube and adjacent said holding surface, means to move said coin-moving member transversely of said first end of said coin-holding tube, and a connection between said coin-moving member and said means for moving said coin-moving member between a first position and a second position adjacent said first end of said coin-holding tube, said connection interconnecting said coin-moving member and said means for moving said coin-moving member but permitting relative angular movement between said coin-moving member and said means for moving said coin-moving member, said coin-moving member having a coin-engaging surface thereon which is disposed radially outwardly of the inner periphery of said coin-holding tube whenever said coin-moving member is in said first position and is disposed radially inwardly of said inner periphery of said coin-holding tube whenever said coin-moving member is in said second position, said coin-engaging surface being disposed at one side of the axis of said coin-holding tube and said connection being disposed at the opposite side of said axis of said coinholding tube whenever said coin-moving member is in said first position, said coin-engaging surface engaging a coin and responding to movement of said coin-moving member transversely of said first end of said coin-holding tube from said first position to said second position to pull said coin transversely away from said first end of said coin-holding tube, said coin defining two planes whenever it is held adjacent said first end of said coin-holding tube, one of said planes being closer to said second end of said coin-holding tube than is the other of said planes, said holding surface being disposed at that side of said one plane which is remote from said second end of said coin-holding tube, said connection always having all portions thereof wholly disposed intermediate said one plane and said second end of said coin-holding tube, whereby an imaginary line which extends between said coin-engaging surface and said connection always passes through said one plane, said connection and said coin-moving member coacting, during the movement of said coin-moving member from said first position to said second position to apply a pulling force along said imaginary line to said coin-engaging surface and thereby develop a component of force, at the point of engagement of said coin-engaging surface with said coin, which is axially directed toward said second end of said coin-holding tube, thereby enabling said coin-engaging surface to press tightly against, and to remain in contact with, said coin as said coin-moving member pulls said coin transversely away from said first end of said coin-holding tube, said coin-moving member having a force-transmitting portion which is disposed at that side of said holding surface which is remote from said second end of said coin-holding tube and extending from one side of said coin-holding tube to the other side of said coin-holding tube whenever said coin-moving member is in said first position, said coin-engaging surface being intermediate said holding surface and said second end of said coin-holding tube and being the free end of a projection which extends from said force-transmitting portion of said coin-moving member toward said second end of said coin-holding tube in a direction generally axially of said coin-holding tube, said holding surface having a slot therein which accommodates said projection on said force-transmitting portion of said coin-moving member, whereby said force-transmitting portion and said coin can be oppositely disposed of said holding surface but said coin-engaging surface can directly engage and move said coin, said component of force which is axially directed toward said second end of said coin-holding tube being a direct function of the application of said pulling force to said coin-engaging surface along said imaginary line, via said connection and said coin-moving member, as said means for moving said coin-moving member acts through said connection and said coin-moving member, to move said coin-moving member from said first position to said second position.

2. A coin-dispensing device as claimed in claim 1 wherein said coin-moving member has a second surface thereon which is in register with but which is displaced from said coin-engaging surface by a distance greater than the inner diameter of said coin-holding tube, wherein said second surface on said coin-moving member is part of a second projection on said force-transmitting portion of said coin-moving member, and wherein said second surface will limit the extent of movement of said coin transversely away from said first end of said coin-holding tube as said coin is moved transversely away from said first end of said coin-holding tube, whereby said second projection performs the dual functions of helping transmit a pulling force from said connection to said coin-engaging surface and of limiting said extent of movement of said coin transversely away from said first end of said coinholding tube.

3. A coin-dispensing device which comprises a coin-holding tube that has a first end and a second end, a holding surface adjacent said first end of said coin-holding tube which can help hold a coin adjacent said first end of said coin-holding tube, a coin-moving member movably mounted adjacent said first end of said coin-holding tube and adjacent said holding surface, means to move said coin-moving member transversely of said first end of said coin-holding tube, a connection between said coin-moving member and said means for moving said coin-moving member between a first position and a second position adjacent said first end of said coin-holding tube, said coin-moving member having a coin-engaging surface thereon which is disposed radially outwardly of the inner periphery of said coin-holding tube whenever said coin-moving member is in said first position and is disposed radially inwardly of said inner periphery of said coin-holding tube whenever said coin-moving member is in said second position, said coin-engaging surface being disposed at one side of the axis of said coin-holding tube and said connection being disposed at the opposite side of said axis of said coin-holding tube whenever said coin-moving member is in said first position, said coin-engaging surface engaging a coin and responding to movement of said coin-moving member transversely of said first end of said coin-holding tube from said first position to said second position to pull said coin transversely away from said first end of said coin-holding tube, said coin defining two planes whenever it is held adjacent said first end of said coin-holding tube, one of said planes being closer to said second end of said coin-holding tube than is the other of said planes, said holding surface being disposed at that side of said one plane which is remote from said second end of said coin-holding tube, said connection being disposed intermediate said one plane and said second end of said coin-holding tube, whereby an imaginary line which extends between said coin-engaging surface and said connection passes through said one plane, said connection and said coin-moving member coacting, during the movement of said coin-moving member from said first position to said second position to apply a pulling force along said imaginary line to said coin-engaging surface and thereby develop a component of force, at the point of engagement of said coin-engaging surface with said coin, which is axially directed toward said second end of said coin-holding tube, thereby enabling said coin-engaging surface to press tightly against, and to remain in contact with, said coin as said coin-moving member pulls said coin transversely away from said first end of said coin-holding tube, said coin-moving member having a force-transmitting portion which is disposed at that side of said holding surface which is remote from said second end of said coin-holding tube and extending from one side of said coin-holding tube to the other side of said coin-holding tube whenever said coin-moving member is in said first position, said coin-engaging surface being intermediate said holding surface and said second end of said coin-holding tube and being the free end of a projection which extends from said force-transmitting portion of said coin-moving member toward said second end of said coin-holding tube in a direction generally axially of said coin-holding tube, said holding surface having a slot therein which accommodates said projection on said force-transmitting portion of said coin-moving member, whereby said force-transmitting portion and said coin can be oppositely disposed of said holding surface but said coin-engaging surface can directly engage and move said coin, said force transmitting portion of said coin-moving member being a ring-like portion which is disposed wholly at that side of said holding surface which is remote from said second end of said coinholding tube, and the inner diameter of said ring-like portion being substantially larger than the inner diameter of said coin-holding tube.

4. A coin-dispensing device which comprises a coin-holding tube, a holding surface adjacent one end of said coin-holding tube which can help hold a coin adjacent said one end of said coin-holding tube, a guiding member adjacent said one end of said coin-holding tube which can help guide a coin which is moved transversely away from said one end of said coin-holding tube, a coin-moving member movably mounted adjacent said one end of said coin-holding tube and adjacent said guiding member, means to move said coin-moving member transversely of said one end of said coin-holding tube, said coin-moving member having a ring-like portion with an inner diameter which is substantially larger than the inner diameter of said coin-holding tube, said ring-like portion of said coin-moving member and said one end of said coin-holding tube being oppositely disposed of said holding surface, said ring-like portion having a projection thereon which extends toward said one end of said coin-holding tube and which has a coin-engaging surface thereon which can engage said coin and which can respond to movement of said coin-moving member in one direction transversely of said one end of said coin-holding tube to move said coin transversely away from said one end of said coin-holding tube, a rigid and unyielding camming surface on said guiding member which is in the path of said coin and which will cam said coin away from said guiding member and toward said ring-like portion of said coin-moving member, whereby said coin will be cammed away from said guiding member for movement to and through said ring-like portion of said coin-moving member, and said camming surface being out of the path of said coin-moving member, whereby said coin-moving member can move relative to, but not strike or be deflected by, said camming surface.

5. A coin-dispensing device which comprises a coin-holding tube that has a first end and a second end, a holding surface adjacent said first end of said coin-holding tube which can help hold a coin adjacent said first end of said coin-holding tube, a coin-moving member movably mounted adjacent said first end of said coin-holding tube and adjacent said holding surface, means to move said coin-moving member in one direction transversely of said first end of said coin-holding tube, further means for moving said coin-moving member in the opposite direction transversely of said first end of said coin-holding tube, said coin-moving member having a coin-engaging surface thereof disposed at one face of said holding surface and having a force-transmitting portion thereof displaced from said one face of said holding surface, said holding surface having a slot therein to accommodate said coin-engaging surface, said coin-engaging surface being engageable with said coin and responding to movement of said coin-moving member in said one direction transversely of said first end of said coin-holding tube to dispense said coin, said coin-engaging surface being movable within said slot in said holding surface in a direction axially relative to said coin-holding tube, said coin-engaging surface being biased for movement axially toward said second end of said coin-holding tube and responding to the dispensing of said coin to move axially toward and to engage the consequently-exposed face of the next-to-be-dispensed coin in said coin-holding tube, the bias on said coin-engaging surface being small enough to permit said next-to-be-dispensed coin to move said coin-engaging surface axially away from said first end of said coin-holding tube, said coin-engaging surface being movable far enough axially away from said first end of said coin-holding tube to enable said next-to-be-dispensed coin to engage and be held by said holding surface while said coin-engaging surface is in register with said coin-holding tube, said bias on said coin-engaging surface causing said coin-engaging surface to apply predetermined friction-inducing forces to said exposed face of said next-to-be-dispensed coin, said coin-engaging surface of said coin-moving member responding to movement of said coin-moving member in said opposite direction transversely of said first end of said coin-holding tube to engage and slide across said exposed face of said next-to-be-dispensed coin, said bias on said coin-engaging surface moving said coin-engaging surface axially toward said first end of said coin-holding tube and hence into register with a portion of the periphery of said next-to-be-dispensed coin as said coin-moving member is moved in said opposite direction to move said coin-engaging surface beyond said exposed face of said next-to-be-dispensed coin, the first said means being adapted to develop a force which is greater than the sum of said predetermined friction-inducing forces due to said bias on said coin-engaging surface and the force developed by said further means, and said predetermined friction-inducing forces due to said bias on said coin-engaging surface being smaller than said force developed by said further means, whereby said first said means can move said coin-moving member in said one direction transversely of said coin-holding tube despite said predetermined friction-inducing forces due to said bias on said coin-engaging surface and said force developed by said further means, and whereby said coin-engaging surface applies only predetermined friction-inducing forces to said exposed face of said next-to-be-dispensed coin as said coin-engaging surface slides across said exposed face of said next-to-be-dispensed coin.

6. A coin-dispensing device which comprises a coin-holding tube that has a first end and a second end, a holding surface adjacent said first end of said coin-holding tube which can help hold a coin adjacent said first end of said coin-holding tube, a coin-moving member movably mounted adjacent said first end of said coin-holding tube, means to move said coin-moving member in one direction transversely of said first end of said coin-holding tube, a pivot between said coin-moving member and said means for moving said coin-moving member in said one direction transversely of said first end of said coin-holding tube, said coin-moving member having a coin-engaging surface thereon which can engage a coin held by said coin-holding tube and which can respond to movement of said coin-moving member in said one direction transversely of said first end of said coin-holding tube to move said coin transversely away from said first end of said coin-holding tube, said holding surface having a slot therein to accommodate said coin-engaging surface, said coin-moving member having a force-transmitting portion which is disposed at that side of said holding surface which is remote from said second end of said coin-holding tube, said coin-engaging surface being movable within said slot in said holding surface in a direction axially of said coin-holding tube, said coin-moving member having a connecting portion which extends between said force-transmitting portion and said pivot, and a biasing member which applies a force to said connecting portion of said coin-moving member at that side of said pivot which is remote from said second end of said coin-holding tube, said force coacting with said pivot to develop a rotative moment which can urge said coin-engaging surface on said coin-moving member axially toward said second end of said coin-holding tube, said rotative moment being small enough to enable the next-to-be-dispensed coin to move said coin-engaging surface far enough axially away from said first end of said coin-holding tube to enable said next-to-be-dispensed coin to engage and be held by said holding surface while said coin-engaging surface is in register with said coin-holding tube, said rotative moment moving said coin-engaging surface axially toward said first end of said coin-holding tube and hence into register with a portion of the periphery of said next-to-be-dispensed coin as said coin-moving member is moved in the opposite direction transversely of said coin-holding tube to move said coin-engaging surface beyond the exposed face of said next-to-be-dispensed coin, said pivot being closer, in the axial direction, to said second end of said coin-holding tube than is said coin-engaging surface, whereby forces which said means for moving said coin-moving member apply to said pivot will develop a component of force, at the point of engagement of said coin-engaging surface with a coin, which is axially directed toward said second end of said coin-holding tube, thereby causing said coin-engaging surface to press tightly against, and to remain in contact with, said coin as said coin-moving member moves said coin transversely away from said first and of said coin-holding tube, said component of force which is axially directed toward said second end of said coin-holding tube being a direct function of the application of said forces to said pivot by said means for moving said coin-moving member.

7. A coin-dispensing device as claimed in claim 6 wherein a spring acts upon said biasing member to cause said biasing member to apply said force to said connecting portion of said coin-moving member, wherein said biasing member applies said force to said connecting portion of said coin-moving member in a direction that is transverse of the axis of said coinholding tube, and wherein said force also urges said coin-moving member for movement in the opposite direction transversely of said first end of said coin-holding tube.

8. A coin-dispensing device which comprises a coin-holding tube that has a first end and a second end, a holding surface adjacent said first end of said coin-holding tube which can help hold a coin adjacent said first end of said coin-holding tube, a coin-moving member movably mounted adjacent said first end of said coin-holding tube, means to move said coin-moving member in one direction transversely of said first end of said coin-holding tube, a pivot between said coin-moving member and said means for moving said coin-moving member in said one direction transversely of said first end of said coin-holding tube, said coin-moving member having a coin-engaging surface thereon which can engage a coin held by said coin-holding tube and which can respond to movement of said coin-moving member in said one direction transversely of said first end of said coin-holding tube to move said coin transversely away from said first end of said coin-holding tube, said coin-moving member having a force-transmitting portion which is disposed at that side of said holding surface which is remote from said second end of said coin-holding tube, said coin-engaging surface being movable axially of said coin-holding tube, said coin-moving member having a connecting portion which extends between said force-transmitting portion and said pivot, a biasing member which applies a force to said connecting portion of said coin-moving member at that side of said pivot which is remote from said second end of said coin-holding tube, said force coacting with said pivot to develop a rotative moment which can urge said coin-engaging surface on said coin-moving member axially toward said second end of said coin-holding tube, a spring which acts upon said biasing member to cause said biasing member to apply said force to said connecting portion of said coin-moving member, a lever which is pivotally mounted on a second pivot and which connects said means for moving said coin-moving member to the first said pivot, and said biasing member being a second lever which is pivotally mounted on said second pivot.

9. A coin-dispensing device which comprises a coin-holding tube that has a first end and a second end, a holding surface adjacent said first end of said coin-holding tube which can help hold a coin adjacent said first end of said coin-holding tube, a coin-moving member movably mounted adjacent said first end of said coin-holding tube, means to move said coin-moving member in one direction transversely of said first end of said coin-holding tube, a pivot between said coin-moving member and said means for moving said coin-moving member in said one direction transversely of said first end of said coin-holding tube, said coin-moving member having a coin-engaging surface thereon which can engage a coin held by said coin-holding tube and which can respond to movement of said coin-moving member in said one direction transversely of said first end of said coin-holding tube to move said coin transversely away from said first end of said coin-holding tube, said coin-moving member having a force-transmitting portion which is disposed at that side of said holding surface which is remote from said second end of said coin-holding tube, said coin-engaging surface being movable axially of said coin-holding tube, said coin-moving member having a connecting portion which extends between said force-transmitting portion and said pivot, a biasing member which applies a force to said connecting portion of said coin-moving member at that side of said pivot which is remote from said second end of said coin-holding tube, said force coacting with said pivot to develop a rotative moment which can urge said coin-engaging surface on said coin-moving member axially toward said second end of said coin-holding tube, a spring which acts upon said biasing member to cause said biasing member to apply said force to said connecting portion of said coin-moving member, a lever which is pivotally mounted on a second pivot and which connects said means for moving said coin-moving member to the first said pivot, said biasing member being a second lever which is pivotally mounted on said second pivot, and the moment arm of said biasing member being longer than the moment arm of the first said lever.

10. A coin-dispensing device which comprises a coin-holding tube that has a first end and a second end, a holding surface adjacent said first end of said coin-holding tube which can help hold a coin adjacent said first end of said coin-holding tube, a coin-moving member movably mounted adjacent said first end of said coin-holding tube and adjacent said holding surface, means to move said coin-moving member transversely of said first end of said coin-holding tube, a pivot between said coin-moving member and said means for moving said coin-moving member transversely of said first end of said coin-holding tube, said coin-moving member having a force-transmitting portion which is disposed at that side of said holding surface which is remote from said second end of said coin-holding tube, said coin-moving member having a coin-engaging surface thereon which can engage a coin and which can respond to movement of said coin-moving member in one direction transversely of said first end of said coin-holding tube to move said coin transversely away from said first end of said coin-holding tube, said holding surface having a slot therein to accommodate said coin-engaging surface, said coin-engaging surface being at the free end of a projection which is on said force-transmitting portion of said coin-moving member and which extends through and is movable relative to said slot in said holding surface in a direction axially of said coin-holding tube to enable said coin-engaging surface to engage the next-to-be-dispensed coin held in said coin-holding tube, and said coin-engaging surface on said coin-moving member being biased for movement axially toward said first end of said coin-holding tube, said pivot and the bias on said coin-engaging surface on said coin-moving member coacting to always urge said coin-engaging surface toward a position in register with said next-to-be-dispensed coin held in said coin-holding tube, said coin-engaging surface on said coin-moving member being movable axially toward or away from said first end of said coin-holding tube, said coin-engaging surface being movable far enough axially away from said first end of said coin-holding tube to enable said next-to-be-dispensed coin to engage and be held by said holding surface while said coin-engaging surface is in register with said coin-holding tube, said bias on said coin-engaging surface moving said coin-engaging surface axially toward said first end of said coin-holding tube and hence into register with a portion of the periphery of said next-to-be-dispensed coin as said coin-moving member is moved in the opposite direction transversely of said coin-holding tube to move said coin-engaging surface beyond said exposed face of said next-to-be-dispensed coin.

* * * * *